US011292994B2

(12) United States Patent
Antonacci et al.

(10) Patent No.: US 11,292,994 B2
(45) Date of Patent: Apr. 5, 2022

(54) ALCOHOL-POTENTIATED ANTIMICROBIAL FORMULATIONS CONTAINING A DISINFECTANT MIXTURE

(71) Applicant: CCMP SPE I, LLC, Plano, TX (US)

(72) Inventors: Frank A. Antonacci, Flower Mound, TX (US); Ronald D. Creamer, Rowlett, TX (US)

( * ) Notice: Subject to any disclaimer, the term of this patent is extended or adjusted under 35 U.S.C. 154(b) by 43 days.

(21) Appl. No.: 16/643,920

(22) PCT Filed: Sep. 7, 2018

(86) PCT No.: PCT/US2018/050080
§ 371 (c)(1),
(2) Date: Mar. 3, 2020

(87) PCT Pub. No.: WO2019/051310
PCT Pub. Date: Mar. 14, 2019

(65) Prior Publication Data

US 2020/0208083 A1 Jul. 2, 2020

Related U.S. Application Data

(60) Provisional application No. 62/665,913, filed on May 2, 2018, provisional application No. 62/555,169, filed on Sep. 7, 2017.

(51) Int. Cl.

| | |
|---|---|
| ***C11D 3/48*** | (2006.01) |
| ***C11D 10/04*** | (2006.01) |
| ***C11D 11/00*** | (2006.01) |
| *C11D 1/75* | (2006.01) |
| *C11D 1/90* | (2006.01) |
| *C11D 1/92* | (2006.01) |
| *C11D 9/30* | (2006.01) |
| *C11D 9/44* | (2006.01) |

(52) U.S. Cl.
CPC ..... *C11D 10/04* (2013.01); *C11D 11/0023* (2013.01); *C11D 1/75* (2013.01); *C11D 1/90* (2013.01); *C11D 1/92* (2013.01); *C11D 9/30* (2013.01); *C11D 9/442* (2013.01); *C11D 9/444* (2013.01)

(58) Field of Classification Search
CPC .... C11D 1/62; C11D 1/90; C11D 1/75; C11D 1/72; C11D 3/201; C11D 3/33; C11D 3/48; C11D 7/5077; C11D 11/0023
See application file for complete search history.

(56) References Cited

U.S. PATENT DOCUMENTS

| | | | | |
|---|---|---|---|---|
| 2002/0098159 | A1* | 7/2002 | Wei | A61Q 17/005 424/70.1 |
| 2004/0247685 | A1* | 12/2004 | Modak | A61K 31/79 424/488 |
| 2006/0205619 | A1* | 9/2006 | Mayhall | A61K 8/416 510/130 |
| 2006/0275235 | A1* | 12/2006 | Takeda | C08B 37/0087 424/70.13 |
| 2011/0008267 | A1* | 1/2011 | Arkin | A61P 17/12 424/43 |

* cited by examiner

*Primary Examiner* — Charles I Boyer
(74) *Attorney, Agent, or Firm* — Barnes & Thornburg LLP; Jerry C. Harris, Jr.

(57) ABSTRACT

Alcohol-potentiated antimicrobial soap formulations include an alcohol-potentiated antimicrobial agent ranging from 0.10 to 2.0% (v/v), an alcohol potentiator ranging from 10.0 to 25.0% (v/v), non-ionic surfactants ranging from 0.25 to 5.0% (v/v), an emollient ranging from 0.10 to 3.0% (v/v), solvents ranging from 0.5 to 2.0% (v/v), and a carrier fluid ranging from 70.0 to 90.0% (v/v). Also, alcohol-potentiated hard surface sanitizer formulations include an alcohol-potentiated antimicrobial agent ranging from 0.10 to 1.00% (v/v), 200-proof ethanol ranging from 15.00 to 25.00% (v/v), and water. Also, alcohol-potentiated hard surface disinfectant formulations include a surfactant ranging from 0.50 to 2.00% (v/v), 190 to 200-proof ethanol ranging from 15.00 to 25.00% (v/v), an alcohol-potentiated antimicrobial agent ranging from 0.10 to 2.50, a chelating agent ranging from 0.10 to 1.50% (v/v), and water.

18 Claims, 3 Drawing Sheets

100

300

ALCOHOL-POTENTIATED ANTIMICROBIAL FORMULATIONS CONTAINING A DISINFECTANT MIXTURE

CROSS-REFERENCE TO RELATED APPLICATIONS

This application is a filing under 35 U.S.C. 371 of International Application No. PCT/US2018/050080 entitled "Alcohol-Potentiated Antimicrobial Formulations," filed Sep. 7, 2018, which claims priority to U.S. Provisional Patent Application Nos. 62/555,169 filed Sep. 7, 2017 and 62/665,913 field May 2, 2018, which are incorporated herein by reference.

BACKGROUND

Antimicrobial soaps are a type of cleaning product which include chemical ingredients that assist in the killing of bacterial, fungal, and other microorganisms. For example, conventional antimicrobial soap formulations may include antimicrobial agents such as triclosan, triclocarban, and chloroxylenol. However, some studies suggest the biocidal mechanism of action utilized by common antimicrobial agents is too slow and/or ineffective, potentially leading to antimicrobial resistant strains. These inadequacies may be further compounded by the failure of many to wash their hands for an adequate time. This is specifically concerning in careers which require people to perform tasks with hands that have to be adequately disinfected, such as in the food-service industry or in the medical profession. Therefore, a need exists for improved, fast-acting formulations of antimicrobial soaps.

Similarly, other types of cleaning products, such as hard surface disinfectants and hard surface sanitizers have conventionally included similar antimicrobial agent. Such conventional hard surface disinfectants and hard surface sanitizers may suffer from similar inadequacies. Therefore, a need exists for improved formulations of hard surface disinfectants and hard surface sanitizers.

SUMMARY

In some embodiments disclosed herein, an alcohol-potentiated antimicrobial soap formulation comprises an alcohol-potentiated antimicrobial agent ranging from 0.10 to 2.0% (v/v), an alcohol potentiator ranging from 10.0 to 25.0% (v/v), a surfactant ranging from 0.25 to 5.0% (v/v), an emollient ranging from 0.10 to 3.0% (v/v), and solvents ranging from 0.5 to 2.0% (v/v), and a carrier fluid ranging from 70.0 to 90.0% (v/v). In some embodiments, the antimicrobial agent may comprise a quaternary ammonium chloride, a chlorinated phenol, or combinations thereof. In some embodiments, the quaternary ammonium chloride may comprise benzalkonium chloride, benzethonium chloride, or combinations thereof. In some embodiments, the chlorinated phenol is parachlorometaxylenol. In some embodiments, the alcohol potentiator comprises 200-proof denatured ethanol. In some embodiments, the surfactant comprises a linear alcohol ethoxylate and an amine oxide, for example, cocamidopropylamine oxide. In some embodiments the surfactant comprises a C9-C11 alcohol ethoxylate. In some embodiments, the emollient comprises an aloe vera gel. In some embodiments the solvents comprise phenoxyethanol. In some embodiments, the alcohol-potentiated antimicrobial soap formulation further comprises a thickener ranging from 0.10 to 1.0% (v/v) and the thickener comprises a thickening agent comprising a polycarboxicilic acid neutralized by an alkali comprising diisopropyl amine. In some embodiments, the carrier fluid comprises de-ionized water.

In some embodiments disclosed herein, an alcohol-potentiated antimicrobial formulation comprises an alcohol-potentiated antimicrobial agent ranging from 0.10 to 1.00% (v/v), an alcohol potentiator ranging from 15.00 to 25.00% (v/v), and de-ionized water. In some embodiments, the alcohol potentiator comprises 200-proof denatured ethanol. In some embodiments, the antimicrobial agent may comprises a quaternary ammonium chloride, a chlorinated phenol, or combinations thereof. In some embodiments, the quaternary ammonium chloride may comprise benzalkonium chloride, benzethonium chloride, or combinations thereof. In some embodiments, the alcohol-potentiated antimicrobial formulation is a hard surface sanitizer.

In some embodiments disclosed herein, an alcohol-potentiated antimicrobial formulation comprises a surfactant ranging from 0.50 to 2.00% (v/v), an alcohol potentiator ranging from 15.00 to 25.00% (v/v), an alcohol-potentiated antimicrobial agent ranging from 0.10 to 2.50, a chelating agent ranging from 0.10 to 1.50% (v/v), and de-ionized water. In some embodiments, the alcohol potentiator comprises 190 to 200-proof denatured ethanol. In some embodiments, the antimicrobial agent may comprise a quaternary ammonium chloride, a chlorinated phenol, or combinations thereof. In some embodiments, the quaternary ammonium chloride may comprise benzalkonium chloride, benzethonium chloride, or combinations thereof. In some embodiments, the alcohol-potentiated antimicrobial formulation is a hard surface disinfectant. In some embodiments, the surfactant is zwitterionic. In some embodiments, the surfactant comprises a betaine, an amine oxide, a sulfobetaine, a sultones, or combinations thereof. In some embodiments, the chelating agent comprises ethylenediaminetetraacetatic acid (EDTA), salts of EDTA, salts of methylglycinediacetic acid, salts of tetrasodium iminodisuccinate, or combinations thereof. In some embodiments, the alcohol-potentiated antimicrobial formulation further comprises a dye ranging from 0.001 to 0.50% (v/v). In some embodiments, the alcohol-potentiated antimicrobial formulation further comprises a fragrance ranging from 0.10 to 1.20% (v/v).

BRIEF DESCRIPTION OF THE DRAWINGS

To easily identify the discussion of any particular element or act, the most significant digit or digits in a reference number refer to the figure number in which that element is first introduced.

DETAILED DESCRIPTION

In some embodiments disclosed herein are cleaning product formulation, for example, in the form of hand soaps, hard surface disinfectants, and hard surface sanitizers. In some of the embodiments disclosed herein, the formulation may comprise an alcohol-potentiated antimicrobial agent and an alcohol potentiator. Additionally, in some embodiments the formulation may comprise one or more suitable additive, for example, dependent upon the intended use and characteristics of the formulation.

In some embodiments, the alcohol-potentiated antimicrobial agent may comprise a quaternary ammonium chloride, a chlorinated phenol, or both a quaternary ammonium chloride and a chlorinated phenol. The quaternary ammonium chloride may comprise benzalkonium Chloride, Benzethonium chloride, or combinations thereof. The chlorinated phenol may be parachlorometaxylenol. The alcohol-potentiated antimicrobial agent may be present in the formulation in an amount from about 0.05% to about 3.0% by volume of the formulation, or from about 0.1% to about 2.5%, from about 0.1% to about 1.0%, or from about 0.1% to about 0.50%, from about 0.1% to about 0.30% by volume of the formulation.

Figure 1:
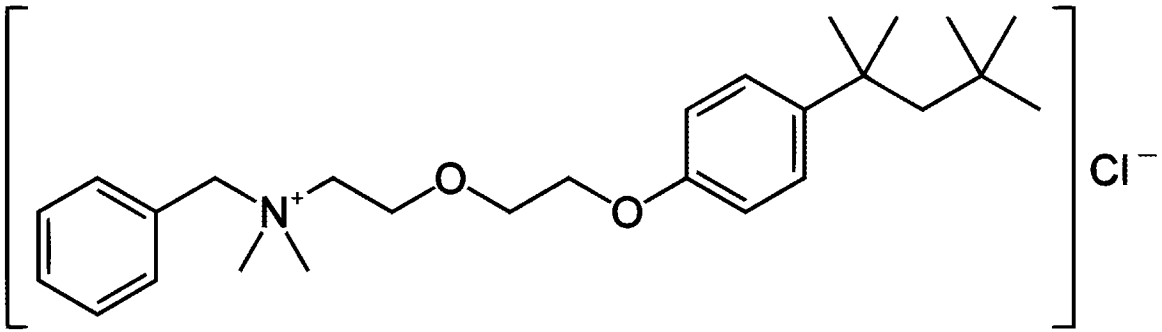
FIG. 1 illustrates a two dimensional skeletal structure 100 of benzethonium chloride.

Referring to FIG. 1, a two dimensional skeletal structure 100 of benzethonium chloride is illustrated. Benzethonium chloride is a synthetic quaternary ammonium salt. It has surfactant, antiseptic, and anti-infective properties, and it is used as a topical antimicrobial agent in first aid kits. Benzethonium chloride exhibits a broad spectrum of microbiocidal activity against bacteria, fungi, mold and viruses. In some studies benzethonium chloride has been shown effective against such pathogens as methicillin-resistant *Staphylococcus aureus, Salmonella, Escherichia coli, Clostridium difficile*, Hepatitis B virus, Hepatitis C virus, Herpes Simplex virus (HSV), Human Immunodeficiency virus (HIV), Respiratory Syncytial virus (RSV), and Norovirus.

Figure 2:
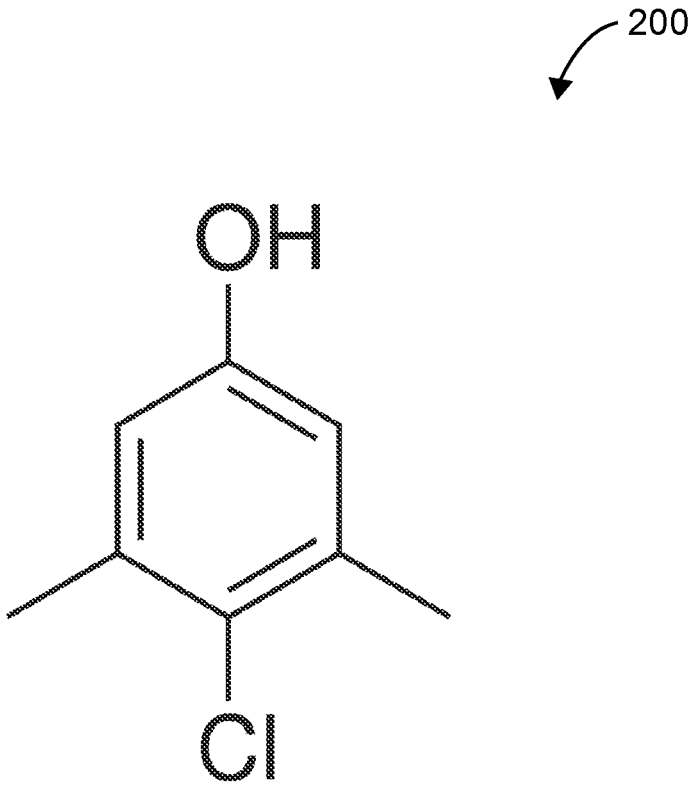
FIG. 2 illustrates a two dimensional skeletal structure 200 of chloroxylenol.

Referring to FIG. 2, a two dimensional skeletal structure 200 of a chloroxylenol is illustrated. Chloroxylenol is also known as para-chloro-meta-xylenol (PCMX) and serves as an antiseptic and disinfectant which is used for skin disinfection and cleaning surgical instruments. Some studies have shown chloroxylenol is most effective against gram-positive bacteria and works by disruption of the cell wall and stopping the function of enzymes.

Figure 3:
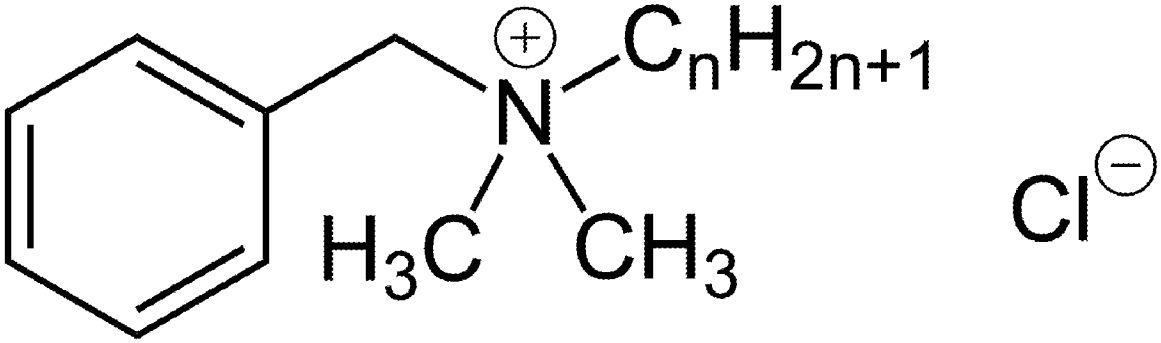
FIG. 3 illustrates a two dimensional skeletal structure 300 of benzalkonium chloride.

Referring to FIG. 3, a two dimensional skeletal structure 300 of benzalkonium chloride is illustrated. Benzalkonium chloride is a type of cationic surfactant. Benzalkonium chloride is an active ingredient in many consumer products and non-consumer products, such as an active ingredient in surgical disinfection. The mechanism of bactericidal/microbicidal action is thought to be due to disruption of intermolecular interactions. Benzalkonium chloride solutions are fast-acting biocidal agents with a moderately long duration of action.

In some embodiments, the alcohol potentiator comprises a denatured alcohol. Not intending to be bound by theory, the presence of the alcohol potentiator may cause the alcohol-potentiated antimicrobial agent to exhibit improved antimicrobial activity in comparison to the same antimicrobial agents, not potentiated via an alcohol.

Examples of suitable alcohols include denatured ethanol and isopropyl alcohol (isopropanol). In various embodiments, the alcohol may be at least 180-proof denatured ethanol, or at least 190-proof denatured ethanol, or at least 195-proof denatured ethanol, or 200-proof denatured ethanol. Other examples of suitable alcohols include specially denatured ethanols including, but not limited to, specially denatured alcohol containing isopropanol (SDA3C) and specially denatured alcohol containing tert-butyl alcohol and denatonium benzoate (SDA40B). The alcohol-potentiator may be present in the formulation in an amount from about 5.0% to about 40.0% by volume of the formulation, or from about 10.0% to about 30.0%, from about 15.0% to about 30.0%, or from about 10.0% to about 25.0%, from about 15.0% to about 25.0% by volume of the formulation.

In some embodiments, the formulation may further comprise a surfactant. The surfactant may be zwitterionic or non-ionic. In some embodiments, the surfactant may comprise a linear alcohol ethoxylate, an amine oxide, a betaine, an amine oxide, a fluorosurfactant, or combinations thereof. Examples of surfactants that may be suitable include, but are not limited to, cocamidopropylamine oxide, a C9-C11 alcohol ethoxylate, cetrimonium chloride (commercially available as Microcare CTC 30). The surfactant may be present in the formation in an amount from about 0.25 to about 5.0% by volume of the formulation.

Additionally or alternatively, in some embodiments the formulation may comprise a carrier fluid, for example, deionized water. The carrier fluid may be present in the formulation in an amount from about 50.0% to about 95.0% by volume of the formulation, or from about 60.0% to about 90.0%, from about 70.0% to about 90.0% by volume of the formulation.

Additionally or alternatively, in some embodiments the formulation may comprise a solvent, for example, phenoxyethanol. The solvent may be present in the formulation in an amount from about 0.25% to about 5.0% by volume of the formulation, or from about 0.5% to about 2.0% by volume of the formulation.

Additionally, in various embodiments the formulation may comprise one or more additives, for example, an emollient, a chelating agent, a thickening agent, a dye, a fragrance, or combinations thereof. Examples of a suitable emollient may include, but are not limited to, aloe vera, a silicone, a polymeric cationic, and similar compounds known in the art, as well as, but not limited to, a substance such as cetrimonium chloride. Examples of a suitable chelating agent include ethylenediaminetetraacetatic acid (EDTA) and salts thereof, such as Ethylenediaminetetraacetic acid tetrasodium (EDTA-$Na_4$). Suitable commercially available examples of chelating agents include Trilon® M available from BASF, which is a trisodium salt of methylglycinediacetic acid ($Na_3$ MGDA) and Baypure CX-100 available from LANXESS, which is a tetrasodium iminodisuccinate. An example of a suitable thickening agent includes polycarboxicilic acid neutralized by an alkali comprising diisopropyl amine. The various additives may be present in amounts generally dependent upon the intended use of the formulation and its desired properties.

In some embodiments, the formulation comprises a fast-acting, alcohol-potentiated antimicrobial soap formulations. The alcohol-potentiated antimicrobial soap formulation may include an alcohol-potentiated antimicrobial agent ranging from 0.10 to 2.0% (v/v), an alcohol potentiator ranging from 10.0 to 25.0% (v/v), surfactants ranging from 0.25 to 5.0% (v/v), an emollient ranging from 0.10 to 3.0% (v/v), solvents ranging from 0.5 to 2.0% (v/v), and a carrier fluid ranging from 70.0 to 90.0% (v/v).

The alcohol-potentiated antimicrobial soap formulation may include a thickener ranging from 0.10 to 1.0% (v/v). The thickener comprises a thickening agent that preferably includes a polycarboxicilic acid neutralized by an alkali comprising diisopropyl amine.

The formulation is preferably a quaternary ammonium chloride and/or parachlorometaxylenol based soap, for killing a broad spectrum of bacteria (e.g., a 2-log bacterial reduction minimum effect) in five seconds or less of exposure. The quaternary ammonium chloride is preferably potentiated with alcohol.

In some embodiments, the formulation comprises a fast-acting, alcohol-potentiated hard surface sanitizer formulations. The alcohol-potentiated hard surface sanitizer formulation may include an alcohol-potentiated antimicrobial agent such as benzalkonium chloride ranging from 0.10 to 1.00% (v/v), 200-proof ethanol ranging from 15.00 to 25.00% (v/v), and water.

In some embodiments, the formulation comprises an alcohol-potentiated hard surface disinfectant formulations. These alcohol-potentiated hard surface disinfectant formulations include a surfactant ranging from 0.50 to 2.00% (v/v), 190 to 200-proof ethanol ranging from 15.00 to 25.00% (v/v), an alcohol-potentiated antimicrobial agent such as benzalkonium chloride or benzathonium chloride ranging from 0.10 to 2.50, a chelating agent ranging from 0.10 to 1.50% (v/v), and water. Optionally, the alcohol-potentiated hard surface disinfectant formulations includes a dye ranging from 0.001 to 0.50% (v/v) and/or a fragrance ranging from 0.10 to 1.20% (v/v).

In various embodiments, the alcohol-potentiated antimicrobial soap formulations disclosed herein may be characterized as relatively mild with respect to the skin. The alcohol-potentiated antimicrobial soap formulations may also be characterized as exhibiting light-to-medium viscosity, for example, such that the formulations provide full coverage when applied to the skin and an aesthetically appealing feel, which encourages hand washing. Unlike ethanol-based sanitizers, the active ingredient does not volatize to ineffective amounts quickly (e.g., within seconds of application).

The alcohol-potentiated antimicrobial soap formulations may provide a quicker bacteria kill than existing market products (e.g., acting more like a sanitizer than a soap). These alcohol-potentiated antimicrobial soap formulations may be effective to reduce concentrations of bacteria on surfaces more effectively in comparison to conventional formulations that only include quaternary ammonium chloride, without alcohol.

Such formulations may be generally less irritating than current available formulations, reducing dried and cracked hands that could potentially expose individuals to infections. Furthermore, unlike alcohol sanitizer, the entire active ingredient is not volatized away within seconds of application.

In some embodiments, the formulation includes a quaternary ammonium chloride or a chlorinated phenol (parachlorometaxylenol) potentiated with an alcohol to achieve broad spectrum bacterial kill at five seconds or less. This formulation comprises between 0.10 to 1.75% (v/v) of a quaternary ammonium chloride potentiated with 10.0-25.0 (v/v) alcohol (i.e., ethanol or isopropyl alcohol). The formulation may be thickened with a polycarboxicilic acid neutralized with an alkali (e.g., diisopropyl amine, trimethylamine (TEA), and etc.) or non-ionic polymeric thickeners (e.g., acrylates), cellulosic thickeners, xanthan gum, or a combination of these thickeners. The formulation may include surfactants at percentages from 0.25 to 5.0% (v/v). The surfactant may comprise a betaine, an amine oxide, a fluorosurfactant, or combinations thereof. The formulation may include an emollient from a group including aloe vera, silicones polymeric cationics, and similar compounds known in the art, as well as, but not limited to, a substance such as cetrimonium chloride. The formulation may include a solvent such as phenoxyethanol in a range between 0.5%-2.0% (v/v).

Such alcohol-potentiated antimicrobial soap formulations utilize alcohol to potentiate the quaternary ammonium chloride, rather than as a solvent. In some embodiments, parachlorometaxylenol may be substituted for the quaternary ammonium chloride and benefit from being potentiated by alcohol.

The various thickening systems and surfactants are described to illustrate embodiments of the formulation with different implementations. The various short chain alcohols (ethanol/isopropanol) may be utilized to potentiate the quaternary ammonium chloride, rather than as solvents.

Certain, particular formulations are shown below:

TABLE 1

| Formulation #1 | |
|---|---|
| Ingredient | %(V/V) |
| Premix #1 | |
| De-ionized Water | 70.0-90.0 |
| Carbopal Ultrez 10 | 0.20-0.65 |
| Biosoft 91-8 | 0.20-0.55 |
| Phenoxyethanol | 0.5-1.5 |
| Iodopropynyl Butylcarbamate | 0.00-0.10 |
| Aloe Vera Gel | 0.1-0.5 |
| Premix #2 | |
| Isopropyl Myristate | 1.5-3.0 |
| 200-Proof Denatured Ethanol | 10.0-30.0 |
| Diisopropylamine | 0.13-0.25 |
| Benzalkonium Chloride (50%) | 0.10-0.27 |

Table 1 illustrates the ingredients utilized in an embodiment of an alcohol-potentiated antimicrobial soap formulation. Formulation 1 is formed through a combination of two premixes. Pre-mix 1 comprises Deionized water, Carbopal Ultrez 10 (carbomer), Biosoft 91-8, phenoxyethanol, iodopropynyl butylcarbamate, and aloe vera gel. Deionized water is the carrier fluid ranging between 70.0-90.0% (v/v). Carbopal Ultrez 10 may function as the thickener ranging between 0.20-0.65% (v/v). The Biosoft 91-8 is a C9-C11 alcohol ethoxylate that may function as a surfactant and ranging between 0.20-0.55% (v/v). Phenoxyethanol may function as a solvent and/or a preservative ranging between 0.50-1.50% (v/v). Iodopropynyl butylcarbamate (Glycacil L) a water-soluble preservative and a member of the carbamate family of biocides. Iodopropynyl butylcarbamate may range between 0.0-0.1% (v/v). Aloe vera gel may function as an emollient ranging between 0.1-0.5% (v/v). In this example, the ingredients of pre-mix are mixed for a minimum of two hours and prepared at room temperature.

Premix 2 comprises isopropyl myristate, 200-proof denatured ethanol, Diisopropylamine, and benzalkonium chloride (50%). Isopropyl myristate may function as a polar emollient ranging between 1.5-3.0% (v/v). The 200-proof denatured ethanol may function as the alcohol potentiator for the antimicrobial agent ranging between 10.0-30.0% (v/v). Diisopropylamine is an ethanolamine and may function as an alkaline neutralizer. The diisopropylamine ranges between 0.13-0.25% (v/v). Benzalkonium chloride (50%) is the antimicrobial agent, provided at half concentration and ranging between 0.10-0.27% (v/v). The ingredients of premix 2 are mixed for a minimum of 30 minutes in this example. Premix 2 is then mixed into premix 1, while premix 1 is being mixed. When the two premixes are completely incorporated, the combined mixture is mixed for a minimum of one hour in this example.

In formulation 1, surfactants are not limited to linear alcohol ethoxylates and may include betaines, amine oxides and other surfactants that are either non-ionic or zwitterionic. The emollient are not limited to aloe vera gel and may include silicones and polymeric cationic emollient and potentially other ingredients. Other specially denatured ethanols may be utilized as the alcohol potentiators that include, but are not limited to, specially denatured alcohol containing isopropanol (SDA3C) and specially denatured alcohol containing tert-butyl alcohol and denatonium benzoate (SDA40B). Alkaline neutralizers may include alki such as diisopropylamine as well as, but not limited to, ethanolamines. Formulation 1 utilizes benzalkonium chloride as the active ingredient but, parachlorometaxylenol and Benzethonium chloride are also options for the active ingredient. Thickeners are not limited to Carbopol Ultrez 10 and may include non-ionic polymeric thickeners, xanthan gums, urethane thickeners, etc.

TABLE 2

| Formulation #2 | |
|---|---|
| Ingredient | %(V/V) |
| De-ionized Water | 70.0-80.0 |
| Cocamidopropylamine Oxide | 0.50-5.00 |
| Theta Care AFP-33 | 2.50-5.00 |
| Aloe Vera Gel | 0.10-0.75 |
| 200-Proof Denatured Ethanol | 10.0-25.0 |
| Benzalkonium Chloride (50%) | 0.10-0.27 |
| Iodopropynyl Butylcarbamate | 0.10-0.20 |

Table 2 illustrates the ingredients of formulation 2, an embodiment of an alcohol-potentiated antimicrobial soap formulation. Formulation 2 comprises Deionized water, cocamidopropylamine oxide, Theta Care AFP-33, aloe vera gel, 200-proof denatured ethanol, benzalkonium chloride, and iodopropynyl butylcarbamate. Deionized water is the carrier fluid ranging between 70.0-80.0% (v/v). Cocamidopropylamine oxide may function as a surfactant ranging between 0.50-5.00% (v/v). Theta Care AFP-33 may function as a surfactant ranging between 2.50-5.00% (v/v). 200-proof denatured ethanol may function as the alcohol potentiator for the antimicrobial agent ranging between 10.0-25.0% (v/v). Benzalkonium chloride (50%) is the antimicrobial agent, provided at half concentration and ranging between 0.10-0.27% (v/v). Iodopropynyl butylcarbamate (Glycacil L) a water-soluble preservative and a member of the carbamate family of biocides. Iodopropynyl butylcarbamate may range between 0.10-0.20% (v/v). Aloe vera gel may function as an emollient ranging between 0.10-0.75% (v/v).

In formulation 2, surfactants are not limited to cocamidopropylamine oxide and may include other amine oxides and beataines. The emollient of formulation 2 utilizes aloe vera gel, but may include polymeric cations and silicones. Other specially denatured ethanols may be utilized as the alcohol potentiators that include, but are not limited to, specially denatured alcohol including isopropanol (SDA3C) and specially denatured alcohol including tert-butyl alcohol and denatonium benzoate (SDA40B). In Formulation 2, benzalkonium chloride as the active ingredient but, parachlorometaxylenol and benzethonium chloride are also options for the active ingredient.

TABLE 3

| Formulation #3 | |
|---|---|
| Ingredient | %(V/V) |
| De-ionized Water | 70.0-85.0 |
| Hydroxyethyl Cellulose | 0.5-1.0 |
| 200-Proof Denatured Ethanol | 10.0-27.5 |
| Benzalkonium Chloride (50%) | 0.10-0.27 |
| Aloe Vera Gel | 0.10-0.50 |
| Linier Alcohol Ethoxylate | 0.10-0.80 |

TABLE 3-continued

| Formulation #3 | |
|---|---|
| Ingredient | %(V/V) |
| Cetrimonium Chloride | 1.00-2.75 |
| Amine Oxide | 0.5-5.0 |
| Thetcare AFP-33 | 0.5-3.0 |

Table 3 illustrates the ingredients of formulation 3, an embodiment of an alcohol-potentiated antimicrobial soap formulation. Formulation 3 comprises de-ionized water, Hydroxyethyl Cellulose, 200-proof denatured ethanol, benzalkonium chloride (50%), aloe vera gel, linier alcohol ethoxylate, Microcare CTC 30, amine oxide, and Thetcare AFP-33. Deionized water is the carrier fluid ranging between 70.0-85.0% (v/v). Hydroxyethyl Cellulose may function as a thickener ranging between 0.5-1.0% (v/v). In this example, hydroxyethyl cellulose may be mixed continuously for four hours prior to being added to the mixture of formulation 3. The 200-proof denatured ethanol may function as the alcohol potentiator for the antimicrobial agent ranging between 10.0-30.0% (v/v). Benzalkonium chloride (50%) is the antimicrobial agent, provided at half concentration and ranging between 0.10-0.27% (v/v). Aloe vera gel may function as an emollient ranging between 0.1-0.5% (v/v). Linier alcohol ethoxylate may function as a surfactant ranging between 0.1-0.8% (v/v). Cetrimonium chloride (Microcare CTC 30) may function as an antiseptic and a surfactant ranging between 1.0-2.75% (v/v). The amine oxide may function as a surfactant ranging between 0.5-5.0% (v/v). Theta Care AFP-33 may function as a surfactant ranging between 2.5-5.00% (v/v).

In formulation 3, the thickener may not be limited to hydroxyethyl cellulose and may include hydroxymethyl cellulose and urethane thickeners. Other specially denatured ethanols may be utilized as the alcohol potentiators that include, but are not limited to, specially denatured alcohol containing isopropanol (SDA3C) and specially denatured alcohol containing tert-butyl alcohol and denatonium benzoate (SDA40B). The emollient of formulation 3 utilizes aloe vera gel, but may include polymeric cations and silicones. In formulation 3, various amine oxides may be utilized including, but not limited to, lauramine oxide.

TABLE 4

| Formulation #4 | |
|---|---|
| Ingredient | %(V/V) |
| De-ionized Water | q.s. |
| 200 Proof Denatured Ethanol | 15.0-25.0 |
| Benzalkonium Chloride (50%) | 0.1-1.0 |

Table 4 illustrates the ingredients of formulation 4, an embodiment of an alcohol-potentiated hard surface sanitizer. Formulation 4 comprises de-ionized water, 200-proof denatured ethanol, and benzalkonium chloride (50%). The 200-proof denatured ethanol may function as the alcohol potentiator for the antimicrobial agent ranging between 15.0-25.0% (v/v). Benzalkonium chloride (50%) is the antimicrobial agent, provided at half concentration and ranging between 0.1-1.0% (v/v). Deionized water is the carrier fluid and is present in an amount quantum satis.

In formulation 4, other specially denatured ethanols that may be utilized as the alcohol potentiators include, but are not limited to, specially denatured alcohol containing isopropanol (SDA3C) and specially denatured alcohol containing tert-butyl alcohol and denatonium benzoate (SDA40B). Although benzalkonium chloride is used as the antimicrobial agent, parachlorometaxylenol and benzethonium chloride are also options.

TABLE 5

| Formulation #5 | |
|---|---|
| Ingredient | %(V/V) |
| De-ionized Water | q.s. |
| Zwitterionic surfactants | 0.50-2.00 |
| 190-200-Proof Ethanol | 15.00-25.00 |
| Benzalkonium Chloride | 0.10-2.50 |
| Chelating agent | 0.10-1.50 |
| Fragrance | 0.10-1.20 |
| Dye | 0.001-0.50 |

Table 5 illustrates the ingredients of formulation 5 an embodiment of an alcohol-potentiated hard surface disinfectant. Formulation 5 comprises de-ionized water, a suitable commercially available zwitterionic surfactant, 190 to 200-proof ethanol, benzalkonium chloride, a chelating agent, and, optionally, suitable commercially available dyes and/or fragrances. The 190 to 200-proof ethanol may function as the alcohol potentiator for the antimicrobial agent ranging between 15.0-25.0% (v/v). Benzalkonium Chloride (50%) is the antimicrobial agent, ranging between 0.1-2.50% (v/v). Deionized water is the carrier fluid and is present in an amount quantum satis.

In formulation 5, other specially denatured ethanols that may be utilized as the alcohol potentiators include, but are not limited to, specially denatured alcohol containing isopropanol (SDA3C) and specially denatured alcohol containing tert-butyl alcohol and denatonium benzoate (SDA40B). Although benzalkonium chloride is used as the antimicrobial agent, benzethonium chloride is also an option. Examples suitable for use as the zwitterionic surfactant include betaines, amine oxides, sulfobetaines, and sultones. Examples suitable for use as the chelating agent include ethylenediaminetetraacetatic acid (EDTA) and salts thereof, such as Ethylenediaminetetraacetic acid tetrasodium (EDTA-$Na_4$). Suitable commercially available examples of chelating agents include Trilon® M available from BASF, which is a trisodium salt of methylglycinediacetic acid ($Na_3$ MGDA) and Baypure CX-100 available from LANXESS, which is a tetrasodium iminodisuccinate.

Also disclosed herein are certain specific embodiments, which are examples of the disclosure.

In a first embodiment, an alcohol-potentiated antimicrobial soap formulation comprises an alcohol-potentiated antimicrobial agent ranging from 0.10 to 2.0% (v/v), an alcohol potentiator ranging from 10.0 to 25.0% (v/v), a surfactant ranging from 0.25 to 5.0% (v/v), an emollient ranging from 0.10 to 3.0% (v/v), a solvent ranging from 0.5 to 2.0% (v/v), and a carrier fluid ranging from 70.0 to 90.0% (v/v).

In a second embodiment, which is the alcohol-potentiated antimicrobial formulation of the first embodiment, the antimicrobial agent comprises a quaternary ammonium chloride, a chlorinated phenol, or combinations thereof.

In a third embodiment, which is the alcohol-potentiated antimicrobial formulation of the second embodiment, the quaternary ammonium chloride comprises benzalkonium chloride, benzethonium chloride, or combinations thereof.

In a fourth embodiment, which is the alcohol-potentiated antimicrobial formulation of one of the second or third embodiments, the chlorinated phenol is parachlorometaxylenol.

In a fifth embodiment, which is the alcohol-potentiated antimicrobial formulation of one or the first through the fourth embodiments, the alcohol potentiator comprises 200-proof denatured ethanol.

In a sixth embodiment, which is the alcohol-potentiated antimicrobial formulation of one of the first through the fifth embodiments, the surfactant comprises a linear alcohol ethoxylate and an amine oxide.

In a seventh embodiment, which is the alcohol-potentiated antimicrobial formulation of the sixth embodiment, the amine oxide comprises cocamidopropylamine oxide.

In an eighth embodiment, which is the alcohol-potentiated antimicrobial formulation of one of the first through the seventh embodiments, the surfactant comprises a C9-C11 alcohol ethoxylate.

In a ninth embodiment, which is the alcohol-potentiated antimicrobial formulation of one of the first through the eighth embodiments, the emollient comprises an aloe vera gel.

In a tenth embodiment, which is the alcohol-potentiated antimicrobial formulation of one of the first through the ninth embodiments, the solvent comprises phenoxyethanol.

In an eleventh embodiment, which is the alcohol-potentiated antimicrobial soap formulation of one of the first through the tenth embodiments further comprising a thickener ranging from 0.10 to 1.0% (v/v), wherein the thickener comprises a thickening agent comprising a polycarboxicilic acid neutralized by an alkali comprising diisopropyl amine.

In a twelfth embodiment, which is the alcohol-potentiated antimicrobial formulation of one of the first through the eleventh embodiments, the carrier fluid comprises de-ionized water.

In a thirteenth embodiment, an alcohol-potentiated antimicrobial formulation comprises an alcohol-potentiated antimicrobial agent ranging from 0.10 to 1.00% (v/v), an alcohol potentiator ranging from 15.00 to 25.00% (v/v), and de-ionized water.

In a fourteenth embodiment, which is the alcohol-potentiated antimicrobial formulation of the thirteenth embodiment, the alcohol potentiator comprises 200-proof denatured ethanol.

In a fifteenth embodiment, which is the alcohol-potentiated antimicrobial formulation of one of the thirteenth through the fourteenth embodiments, the antimicrobial agent comprises a quaternary ammonium chloride, a chlorinated phenol, or combinations thereof.

In a sixteenth embodiment, which is the alcohol-potentiated antimicrobial formulation of the fifteenth embodiment, the quaternary ammonium chloride comprises benzalkonium chloride, benzethonium chloride, or combinations thereof.

In a seventeenth embodiment, which is the alcohol-potentiated antimicrobial formulation of one of the thirteenth through the sixteenth embodiments, the alcohol-potentiated antimicrobial formulation is a hard surface sanitizer.

In an eighteenth embodiment, an alcohol-potentiated antimicrobial formulation comprises a surfactant ranging from 0.50 to 2.00% (v/v), an alcohol potentiator ranging from 15.00 to 25.00% (v/v), an alcohol-potentiated antimicrobial agent ranging from 0.10 to 2.50, a chelating agent ranging from 0.10 to 1.50% (v/v), and de-ionized water.

In a nineteenth embodiment, which is the alcohol-potentiated antimicrobial formulation of the eighteenth embodiment, the alcohol potentiator comprises 190 to 200-proof denatured ethanol.

In a twentieth embodiment, which is the alcohol-potentiated antimicrobial formulation of one of the eighteenth through the nineteenth embodiments, the antimicrobial agent comprises a quaternary ammonium chloride, a chlorinated phenol, or combinations thereof.

In a twenty-first embodiment, which is the alcohol-potentiated antimicrobial formulation of the twentieth embodiment, the quaternary ammonium chloride comprises benzalkonium chloride, benzethonium chloride, or combinations thereof.

In a twenty-second embodiment, which is the alcohol-potentiated antimicrobial formulation of one of the eighteenth through the twenty-first embodiments, the alcohol-potentiated antimicrobial formulation is a hard surface disinfectant.

In a twenty-third embodiment, which is the alcohol-potentiated antimicrobial formulation of one of the eighteenth through the twenty-second embodiments, the surfactant is zwitterionic.

In a twenty-fourth embodiment, which is the alcohol-potentiated antimicrobial formulation of the eighteenth through the twenty-third embodiments, the surfactant comprises a betaine, an amine oxide, a sulfobetaine, a sultones, or combinations thereof.

In a twenty-fifth embodiment, which is the alcohol-potentiated antimicrobial formulation of one of the eighteenth through the twenty-third embodiments, the chelating agent comprises ethylenediaminetetraacetatic acid (EDTA), salts of EDTA, salts of methylglycinediacetic acid, salts of tetrasodium iminodisuccinate, and combinations thereof.

In a twenty-sixth embodiment, which is the alcohol-potentiated antimicrobial formulation of one of the eighteenth through the twenty-fifth embodiments further comprising a dye ranging from 0.001 to 0.50% (v/v).

In a twenty-seventh embodiment, which is the alcohol-potentiated antimicrobial formulation of one of the eighteenth through the twenty-sixth embodiments further comprising a fragrance ranging from 0.10 to 1.20% (v/v).

The foregoing description of embodiments and examples has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate certain principles and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. An alcohol-potentiated antimicrobial formulation comprising:

a) an alcohol-potentiated antimicrobial agent ranging from 0.10 to 2.0% (v/v), wherein the antimicrobial agent comprises a quaternary ammonium chloride and a chlorinated phenol;

b) an alcohol potentiator present in an amount of 40% (v/v);

c) a surfactant ranging from 0.25 to 5.0% (v/v);

d) an emollient ranging from 0.10 to 3.0% (v/v);

e) additional solvents ranging from 0.5 to 2.0% (v/v); and f) deionized water.

2. The alcohol-potentiated antimicrobial formulation of claim 1, wherein the quaternary ammonium chloride comprises benzalkonium chloride, benzethonium chloride, or combinations thereof.

3. The alcohol-potentiated antimicrobial formulation of claim 1, wherein the chlorinated phenol is parachlorometaxylenol.

4. The alcohol-potentiated antimicrobial formulation of claim 1, wherein the alcohol potentiator comprises 200-proof denatured ethanol.

5. The alcohol-potentiated antimicrobial formulation of claim 1, wherein the surfactant comprises a linear alcohol ethoxylate and an amine oxide.

6. The alcohol-potentiated antimicrobial formulation of claim 5, wherein the amine oxide comprises cocamidopropylamine oxide.

7. The alcohol-potentiated antimicrobial formulation of claim 1, wherein the surfactant comprises a C9-C11 alcohol ethoxylate.

8. The alcohol-potentiated antimicrobial formulation of claim 1, wherein the emollient comprises an aloe vera gel.

9. The alcohol-potentiated antimicrobial formulation of claim 1, wherein the solvents comprise phenoxyethanol.

10. The alcohol-potentiated antimicrobial formulation of claim 1 further comprising a thickener ranging from 0.10 to 1.0% (v/v), wherein the thickener comprises a thickening agent comprising a polycarboxylic acid neutralized by an alkali comprising diisopropyl amine.

11. The alcohol-potentiated antimicrobial formulation of claim 1, wherein the alcohol-potentiated antimicrobial formulation is a hard surface sanitizer.

12. The alcohol-potentiated antimicrobial formulation of claim 1 further comprising:

g) a chelating agent ranging from 0.10 to 1.50% (v/v).

13. The alcohol-potentiated antimicrobial formulation of claim 12, wherein the alcohol-potentiated antimicrobial formulation is a hard surface disinfectant.

14. The alcohol-potentiated antimicrobial formulation of claim 12, wherein the surfactant is zwitterionic.

15. The alcohol-potentiated antimicrobial formulation of claim 12, wherein the surfactant comprises a betaine, an amine oxide, a sulfobetaine, a sultones, or combinations thereof.

16. The alcohol-potentiated antimicrobial formulation of claim 12, wherein the chelating agent comprises ethylenediaminetetraacetatic acid (EDTA), salts of EDTA, salts of methylglycinediacetic acid, salts of tetrasodium iminodisuccinate, and combinations thereof.

17. The alcohol-potentiated antimicrobial formulation of claim 12, further comprising a dye ranging from 0.001 to 0.50% (v/v).

18. The alcohol-potentiated antimicrobial formulation of claim 12, further comprising a fragrance ranging from 0.10 to 1.20% (v/v).

* * * * *